US011796160B2

(12) United States Patent
Lei

(10) Patent No.: US 11,796,160 B2
(45) Date of Patent: Oct. 24, 2023

(54) HIGH-INSULATION INTEGRATED PLASTIC LAMP HOLDER

(71) Applicant: Dongguan Miray E-Tech Co., Ltd, Guangdong (CN)

(72) Inventor: Jianwen Lei, Guangdong (CN)

(73) Assignee: DONGGUAN MIRAY E-TECH CO., LTD, Guangdong (CN)

( * ) Notice: Subject to any disclaimer, the term of this patent is extended or adjusted under 35 U.S.C. 154(b) by 0 days.

(21) Appl. No.: 17/839,371

(22) Filed: Jun. 13, 2022

(65) Prior Publication Data

US 2023/0296228 A1 Sep. 21, 2023

(30) Foreign Application Priority Data

Mar. 18, 2022 (CN) ..... 202220608078.1

(51) Int. Cl.
*F21V 19/00* (2006.01)
*H01R 33/22* (2006.01)
*H01R 33/08* (2006.01)

(52) U.S. Cl.
CPC ..... *F21V 19/0055* (2013.01); *F21V 19/0065* (2013.01); *H01R 33/22* (2013.01); *H01R 33/0863* (2013.01)

(58) Field of Classification Search
CPC ..... H01R 33/22; H01R 33/05; H01R 33/06; H01R 33/0863; H01R 33/94; F21V 19/0055; F21V 19/0065
See application file for complete search history.

(56) References Cited

U.S. PATENT DOCUMENTS 5,634,820 A * 6/1997 Vakil ..... H01J 61/325 315/56

FOREIGN PATENT DOCUMENTS

DE 102021120851 A1 * 2/2023
FR 3038150 A1 * 12/2016 ..... H01R 33/94

* cited by examiner

*Primary Examiner* — Oscar C Jimenez
*Assistant Examiner* — Paul D Baillargeon
(74) *Attorney, Agent, or Firm* — MagStone Law, LLP; Enshan Hong

(57) ABSTRACT

A high-insulation integrated plastic lamp holder that does not require traditional American and European-standard copper lamp holders, comprising a high-insulation plastic body formed by injection molding. The top of the high-insulation plastic body is provided with a barrier, a first conductive component slot, and a second conductive component slot, and the barrier is located between the first conductive component slot and the second conductive component slot. The first conductive component slot and the second conductive component slot are inserted into positive and negative conductive sheets correspondingly, and the assembly of the lamp holder is simpler, which facilitates automatic production, thereby greatly improving the daily production capacity and insulation, and lowering the cost of production.

8 Claims, 7 Drawing Sheets

HIGH-INSULATION INTEGRATED PLASTIC LAMP HOLDER

CROSS REFERENCE TO RELATED APPLICATIONS

This application claims priority from China Patent Application No. 202220608078.1 filed on Mar. 18, 2022, the entire content of which is hereby incorporated by reference.

TECHNICAL FIELD

The invention relates to the technical field of holiday decoration lamps of American and European standards, in particular to a high-insulation integrated plastic lamp holder that does not require conventional American standard and European standard copper lamp holders.

BACKGROUND

LED lamps are widely used. In the existing LED lamps, the lamp head and the lamp holder are connected through two fixed poles (positive/negative) made of copper parts, and the lamp holder is composed of a copper nut and two fixed electrodes to conduct a power connection. The traditional lamp holder mounting part is located in the middle of the copper nut. First, a middle copper terminal and two other insulating plastic parts are manufactured and fixed in the middle of the copper nut to become an insulating positive pole; the side copper terminal located next to the middle copper terminal is used as the negative pole, and the middle copper terminals and the side copper terminals are installed in the corresponding holes of the lamp holder. In addition, the lamp holder is also stamped and formed with wires. The above-mentioned middle copper terminals, side copper terminals, and wires are all assembled by manual operation, which has a low degree of automation, low work efficiency, and high labor costs. The metal body does not melt with the outer plastic during the secondary injection molding, which easily causes the bulb to not light up; because the lamp holder is made of metal (usually copper), the cost of the lamp holder is very high, and the failure rate of complaints is very high when consumers use it. For example, the cost of an E26 lamp holder is usually about 10 U.S. cents, which makes the manufacturing cost of light string lamps with multiple lamp holders also very high, resulting in a decline in market competitiveness and a high failure rate of complaints.

SUMMARY OF THE INVENTION

Aiming at the problems of the prior art, the present invention provides a high-insulation integrated plastic lamp holder that does not require traditional American and European copper lamp holders, which can facilitate automatic assembly and reduce costs on the premise of ensuring stable power connection, thereby enhancing market competitiveness.

In order to solve the above-mentioned technical problems, the present invention adopts the following technical solutions. The present invention provides a high-insulation integrated plastic lamp holder that does not require traditional American and European standard copper lamp holders, including a high-insulation plastic body, the high-insulation plastic body is integrally formed by injection molding, and the top of the high-insulation plastic body is integrally formed. A barrier, a first conductive component slot, and a second conductive component slot are provided, the barrier is located between the first conductive component slot and the second conductive component slot, and the first conductive component slot and the second conductive component slot are respectively used to insert different polarities of the electrical connectors, and the barrier are used to prevent the two electrical connectors from colliding with each other.

The inner sidewall of the high-insulation plastic body is provided with inner threads for connecting with the screw threads of the lamp cap, and the inner threads and the high-insulation plastic body are integrally formed by injection molding.

The outer sidewall of the high-insulation plastic body is provided with a bump, and the bump is close to the first conductive component slot and is used for automatic equipment to distinguish the first conductive component slot and the second conductive component slot.

Further, the first conductive component slot is located between the bump and the barrier.

Further, the inner top wall of the high-insulation plastic body is provided with a positive top post, and the positive top post is used to collide with the electrical connectors inserted into the first conductive component slot.

Furthermore, the inner top wall of the high-insulation plastic body is recessed upward to form a groove, and the positive pole is located in the groove.

Further, the inner top wall of the high-insulation plastic body protrudes downward to form a limiter.

Furthermore, the inner side wall of the high-insulation plastic body is provided with a negative pole lifting part, the second conductive component slot is located between the negative pole lifting part and the limiter, and the negative pole lifting part is used for positioning and enhancing the resilience of the conductive sheet.

Further, the high-insulation plastic body includes an integrally formed plug-in position and an assembly position, the barrier, the first conductive component slot, and the second conductive component slot are all disposed on the top of the plug-in position, and the assembly position is located at the bottom of plug-in position. The width of the plug-in position gradually increases from the top to the bottom, and the outer sidewall of the assembly position is spaced with a plurality of reinforcement positions. The reinforcement positions are secondary injection molding to increase the mutual firmness of the high-insulation plastic bodies.

Beneficial effects of the present invention: The present invention integrates the high-insulation plastic body by injection molding, and the high-insulation plastic body is provided with a first conductive component slot and a second conductive component slot for stably inserting conductive sheets of different polarities so that the assembly is simpler, which is conducive to the realization of automatic production; and the high-insulation plastic body is made of plastic with lower cost so that the cost is reduced and the competitiveness is improved.

Reference number: 1—High-insulation plastic body, 11—Barrier, 12—the first conductive component slot, 13—the second conductive component slot, 14—Bump, 15—Positive top post, 16—Groove, 17—limiter, 18—negative pole lifting part, 19— inner thread, 110—plug-in position, 111—assembly position, 112—reinforcement positions; 2—electrical connectors, 21— positive pole conductive wire, 22—negative pole conductive wire, 23—first conductive sheet, 24—second conductive sheet.

DETAILED DESCRIPTION OF PREFERRED EMBODIMENTS

In order to facilitate the understanding of those skilled in the art, the present invention will be further described below with reference to the embodiments and the accompanying drawings, and the contents mentioned in the embodiments are not intended to limit the present invention. The present invention will be described in detail below with reference to the accompanying drawings.

Figure 1:
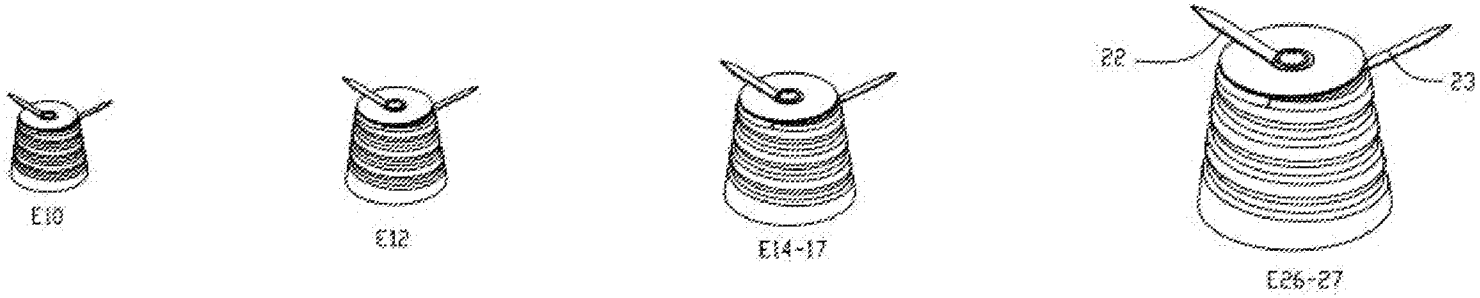
FIG.1 (Prior art)
FIG. 1 is a schematic diagram of lamp sockets of various specifications in the prior art.
Figure 2:
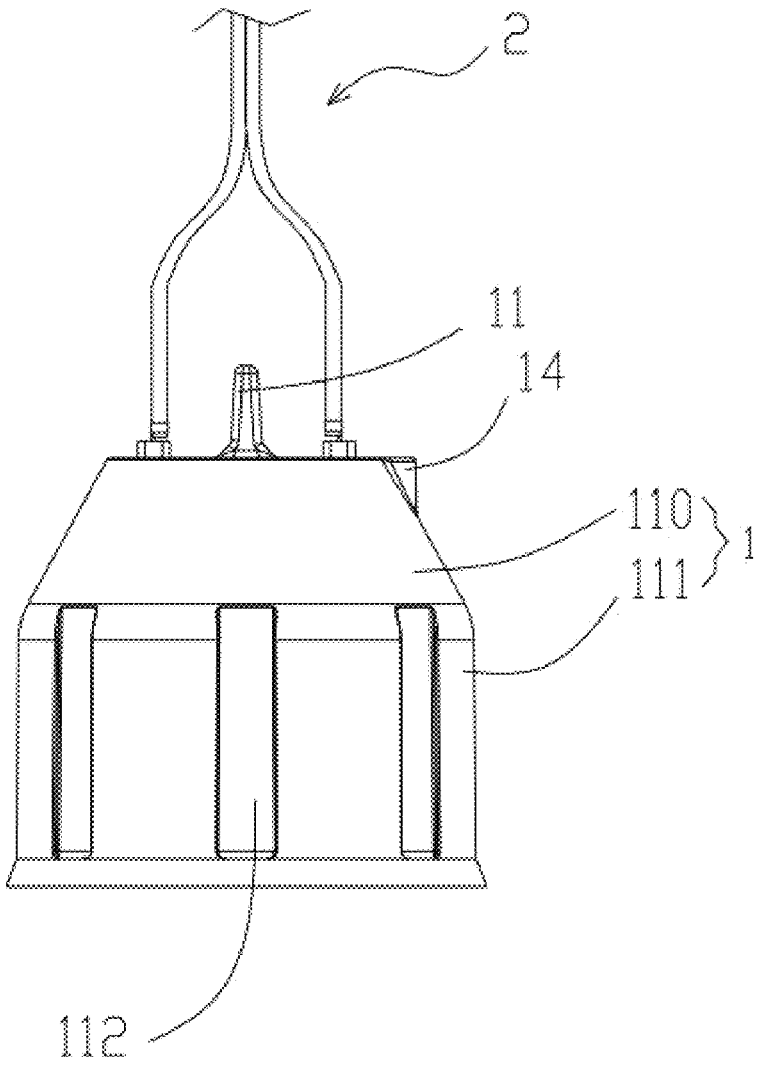
FIG. 2 is a schematic diagram of an embodiment of the present invention when an electrical connection is assembled.
Figure 3:
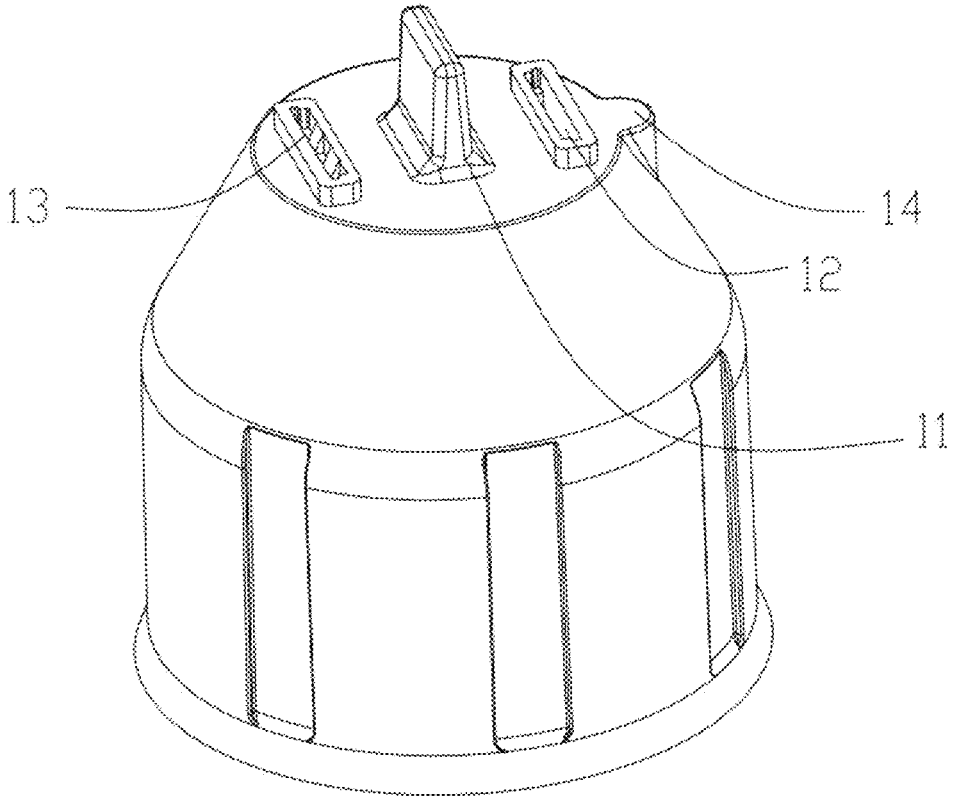
FIG. 3 is a schematic diagram of the high-insulation plastic body of an embodiment of the present invention.
Figure 4:
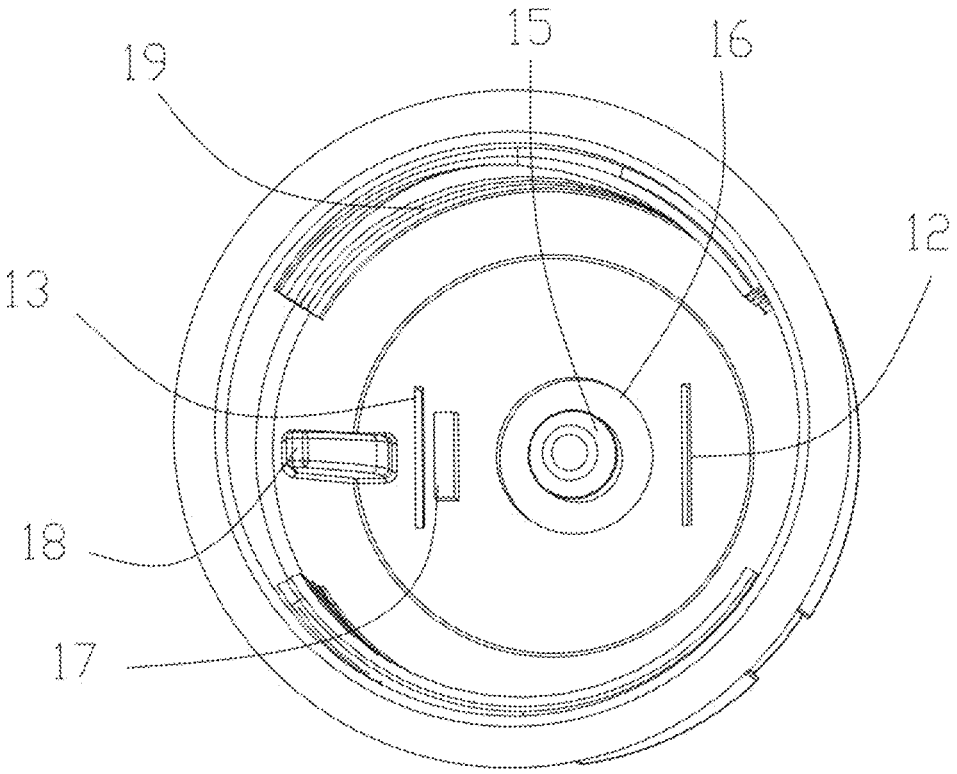
FIG. 4 is an internal schematic diagram of the high-insulation plastic body of an embodiment of the present invention.
Figure 5:
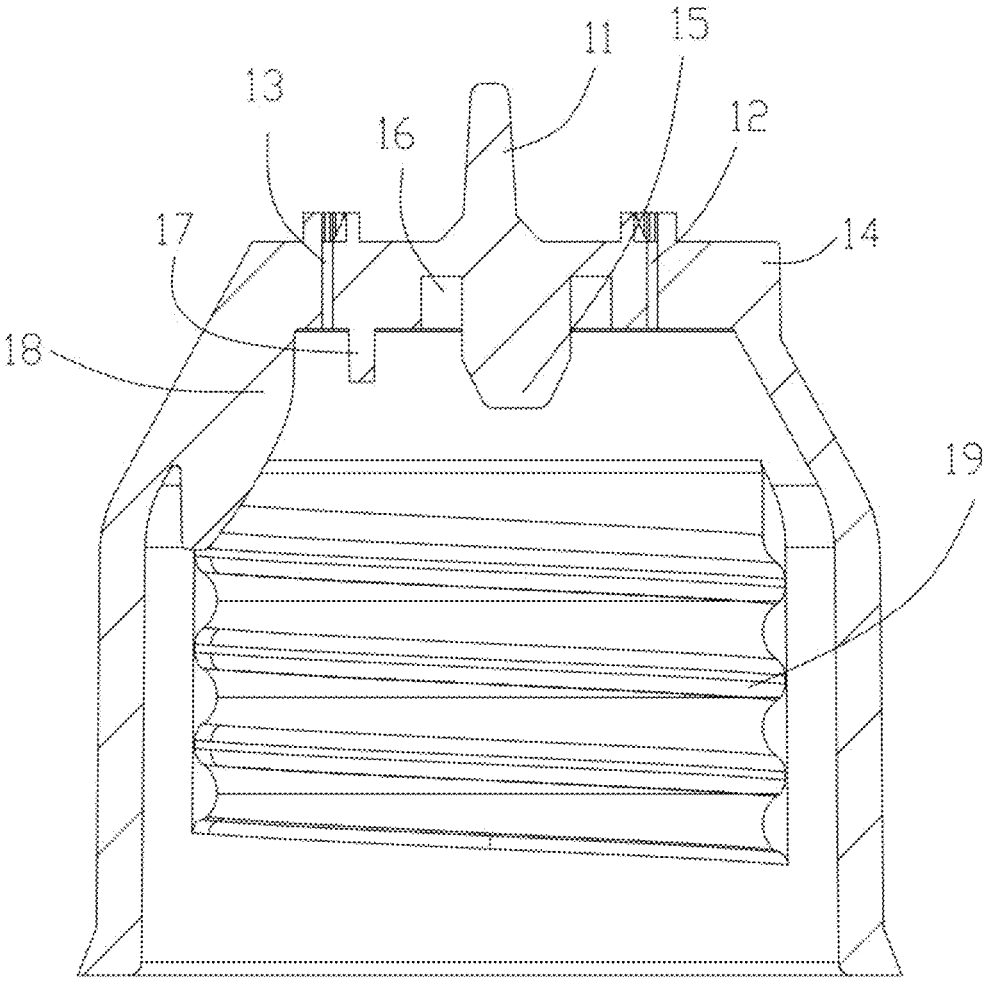
FIG. 5 is a cross-sectional view of the high-insulation plastic body of an embodiment of the present invention.
Figure 6:
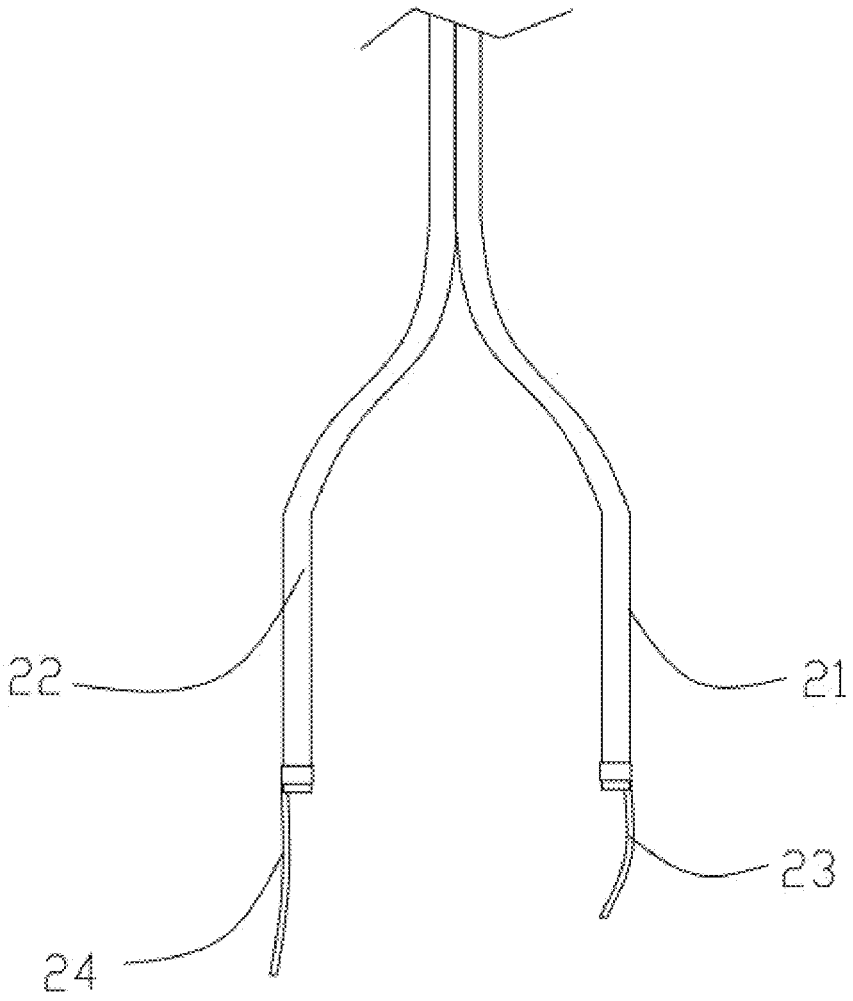
FIG. 6 is a schematic diagram of an electrical connection member of an embodiment of the present invention.
Figure 7:
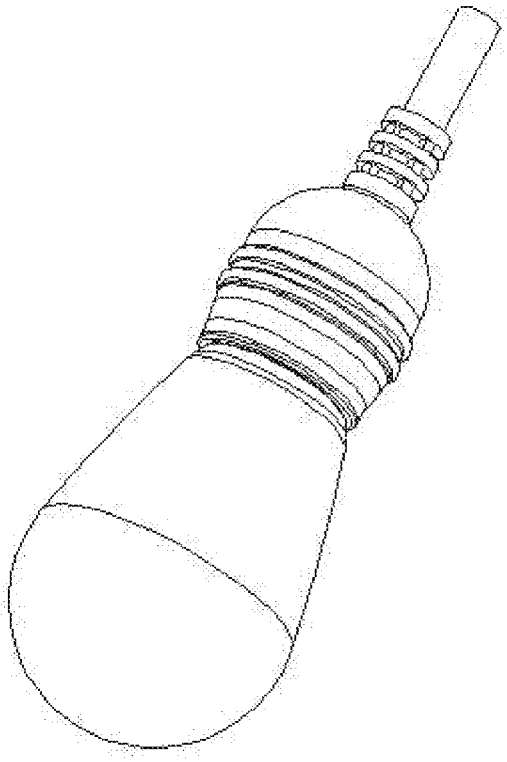
FIG. 7 is a reference diagram of the use state of the high-insulation plastic body of an embodiment of the present invention.
Figure 8:
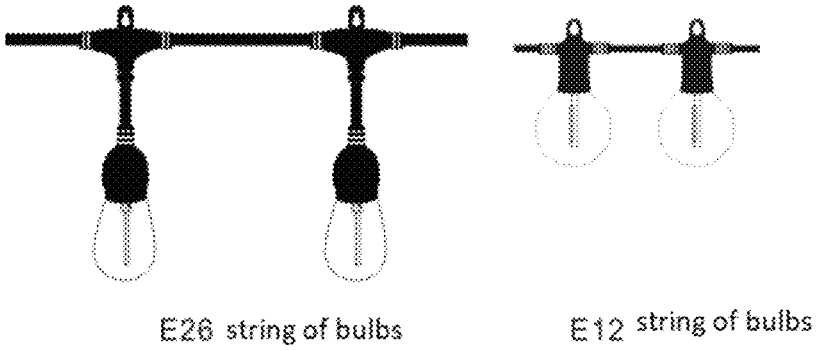
FIG. 8 shows E26 and E12 strings of lamps based on an embodiment of the present invention.

As shown in FIG. 2 to FIG. 7, the present invention provides a high-insulation integrated plastic lamp holder that does not require traditional American and European standard copper lamp holders, including a high-insulation plastic body 1, and the high-insulation plastic body 1 is injection-molded by integrated mold. The top of the high-insulation plastic body 1 is provided with a barrier 11, a first conductive component slot 12, and a second conductive component slot 13, and barrier 11 is located between the first conductive component slot 12 and the second conductive component slots 13. The first conductive component slot 12 and the second conductive component slot 13 are respectively used for inserting different polarities of the electrical connectors 2, and the barrier 11 is used to prevent the two electrical connectors 2 from colliding with each other, thereby prevent the occurrence of short circuit phenomenon.

In actual use, the electrical connectors 2 of the present invention includes a positive pole conductive wire 21 and a negative pole conductive wire 22 for connecting with different polarities respectively, the positive pole conductive wire 21 is provided with a first conductive sheet 23, and the negative pole conductive wire 22 is provided with a second conductive sheet 24. The length of the first conductive sheet 23 is shorter than the length of the second conductive sheet 24, the first conductive sheet 23 is inserted into the first conductive component slot 12, and the second conductive sheet 24 is inserted into the second conductive component slot 13; the barrier 11 is located between the positive pole conductive wire 21 and the negative pole conductive wire 22.

When in use, the first conductive sheet 23 is inserted into the first conductive component slot 12, the second conductive sheet 24 is inserted into the second conductive component slot 13, and then the lamp cap of the light bulb is loaded into the high-insulation plastic body 1 so that the lamp cap is in contact with the first conductive sheet 23 and the second conductive sheet 24 respectively. At this time, since the barrier 11 is located between the first conductive component slot 12 and the second conductive component slot 13, it can prevent the electrical connectors 2 from colliding with the metal parts outside the high-insulation plastic body 1, thereby avoiding the occurrence of short circuit and achieving the effect of stable power connection.

Since the whole of the present invention is made of injection molding, the conductive sheet of the electrical connectors 2 and the high-insulation plastic body 1 can be assembled only by plugging, thereby achieving the effect of automatic production, reducing labor costs and improving efficiency; In addition, the cost of plastic is lower than metal. For example, the cost of making an E26 lamp holder is only between 1.5-3.1 U.S cents, which saves most of the cost and improves market competitiveness. The high-insulation integrated plastic lamp holder provided by the present invention is used for producing various lamp holders, including various types of American and European standard regulations lamp holders, such as E10, E12, E14, E17, E26, E27, and so on.

To prevent misassembly, the length of the first conductive sheet 23 is different from the length of the second conductive sheet 24. The first conductive sheet 23 is inserted into the first conductive component slot 12, the second conductive sheet 24 is inserted into the second conductive component slot 13. In this embodiment, the outer sidewall of the high-insulation plastic body 1 is provided with a bump 14, and the bump 14 is close to the first conductive component slot 12 so that external automation equipment can distinguish the first conductive component slot 12 from the second conductive component slot 13.

Specifically, the first conductive component slot 12 is located between the barrier 11 and the bump 14. That is, the identification and positioning are performed by the arrangement of the bumps 14, so as to reliably distinguish the first conductive component slot 12 and the second conductive component slot 13, avoid the phenomenon of reverse insertion, and achieve the effect of fool proofing.

In accordance with an embodiment of this application, the inner top wall of the high-insulation plastic body 1 is provided with a positive top post 15. That is, when the lamp cap is installed in the high-insulation plastic body 1, it will contact the first conductive sheet 23 and force the first conductive sheet 23 to bend and rebound as the lamp cap is installed. The effect of a conductive sheet 23 moving towards the lamp cap and colliding with it realizes a stable position limit for the first conductive sheet 23 and makes the conflict between the first conductive sheet 23 and the lamp cap more stable, avoiding the occurrence of poor contact.

Specifically, the inner top wall of the high-insulation plastic body 1 is recessed upward to form a groove 16, and the positive top post 15 is located in the groove 16, which is beneficial to increasing the strength of the positive top post 15.

In accordance with an embodiment of this application, the inner top wall of the high-insulation plastic body 1 protrudes downward to form a limiter 17.

Through the setting of the groove 16 and the limiter 17, the first conductive sheet 23 and the second conductive sheet 24 inserted into the high-insulation plastic body 1 can be respectively limited, that is, when both are forced to be deformed by the lamp cap, they will not be deformed in the direction close to each other to avoid the occurrence of short-circuit phenomenon.

Specifically, the inner sidewall of the high-insulation plastic body 1 is provided with a negative pole lifting part 18, the second conductive component slot 13 is located between the negative pole lifting part 18 and the limiter 17, and the negative pole lifting part 18 is used for positioning and enhancing resilience of the second conductive sheet 24. The function of the negative pole lifting part 18 is similar to the positive top post 15, that is, when the second conductive sheet 24 is pressed by the lamp cap and is bent toward the sidewall of the high-insulation plastic body 1, the negative pole lifting part 18 can collide with the second conductive sheet 24 to prevent it from continuing to deform, thereby ensuring the stability of the contact between the lamp cap and the second conductive sheet 24.

In accordance with an embodiment of this application, the inner sidewall of the high-insulation plastic body 1 is provided with inner threads 19 for connecting with the screw threads of the lamp cap. The inner threads 19 and the high-insulation plastic body 1 are integrally formed by injection molding. Conventionally, the inner threads 19 in the plastic shell is usually assembled, but the present invention preferably adopts an integral molding method, which improves the stability of the inner threads 19 and allows the lamp cap to be screwed with the inner threads 19. It can just reach the designated position in the high-insulation plastic body 1 and collides with the first conductive sheet 23 and the second conductive sheet 24.

In accordance with an embodiment of the present application, the high-insulation plastic body 1, including an integrated plug-in position 110 and an assembly position 111, and the barrier 11, the first conductive component slot 12, and the second conductive component slot 13 are all disposed at the top of plug-in position 110. Assembly position 111 is located at the bottom of plug-in position 110. The width of the plug-in position 110 gradually increases from the top to the bottom. The outer sidewall of assembly position 111 is provided with a plurality of reinforcement positions 112 at intervals. Specifically, the reinforcement positions 112 is used for increasing the mutual firmness of the high-insulation plastic body 1 through secondary injection molding.

The above are only preferred embodiments of the present invention and are not intended to limit the present invention in any form. Any simple modifications, equivalent changes, and substitutions without departing from the technical solution of the present invention all fall within the scope of the present invention.

I claim:

1. An integrated plastic lamp holder comprising a plastic body integrally formed by injection molding, wherein:

a barrier for preventing two electrical connectors from colliding with each other, a first conductive component slot, and a second conductive component slot respectively for inserting different polarities of electrical connectors, are provided at the top of the plastic body, the barrier is located between the first conductive component slot and the second conductive component slot;

the plastic body comprises an inner sidewall and an outer sidewall;

the inner sidewall of the plastic body comprises an inner thread for connecting a screw thread of a lamp cap, and the inner thread and the plastic body are integrally formed by injection molding;

the outer sidewall of the plastic body is provided with a bump proximate to the first conductive component slot for facilitating automatic equipment in distinguishing the first conductive component slot from the second conductive component slot;

an inner top wall of the plastic body is provided with a positive top post for interfering with the electrical connector inserted in the first conductive component slot;

the inner top wall of the plastic body protrudes downward to form a limiter; and the inner sidewall of the plastic body is provided with a negative pole lifting part for positioning a conductive sheet and enhancing resilience of the conductive sheet, and the second conductive component slot is located between the negative pole lifting part and the limiter.

2. The integrated plastic lamp holder of claim 1, wherein the first conductive component slot is located between the bump and the barrier.

3. The integrated plastic lamp holder according to claim 1 being free of a copper nut and two fixed electrodes to conduct a power connection.

4. A lamp comprising the integrated plastic lamp holder according to claim 1.

5. A string of lamps comprising a plurality of lamps of claim 4.

6. An integrated plastic lamp holder comprising a plastic body integrally formed by injection molding, wherein:

a barrier for preventing two electrical connectors from colliding with each other, a first conductive component slot, and a second conductive component slot respectively for inserting different polarities of electrical connectors, are provided at the top of the plastic body, the barrier is located between the first conductive component slot and the second conductive component slot;

the plastic body comprises an inner sidewall and an outer sidewall;

the inner sidewall of the plastic body comprises an inner thread for connecting a screw thread of a lamp cap, and the inner thread and the plastic body are integrally formed by injection molding;

the outer sidewall of the plastic body is provided with a bump proximate to the first conductive component slot for facilitating automatic equipment in distinguishing the first conductive component slot from the second conductive component slot; and the plastic body comprises an integrally formed plug-in position and an assembly position, the barrier, the first conductive component slot, and the second conductive component slot are all disposed at the top of the plug-in position, the assembly position is located at the bottom of the plug-in position, the width of the plug-in position gradually increases from the top to the bottom, and a plurality of spaced-apart reinforcers are provided on an outer sidewall of the assembly position, and the reinforcing positions are formed by secondary injection molding for reinforcing connection of different parts of the plastic body.

7. A lamp comprising the integrated plastic lamp holder according to claim 6.

8. A string of lamps comprising a plurality of lamps of claim 7.

* * * * *